US006546873B1

(12) United States Patent
Andrejkovics et al.

(10) Patent No.: US 6,546,873 B1
(45) Date of Patent: Apr. 15, 2003

(54) APPARATUS FOR REMOTE ACTIVATION OF EQUIPMENT AND DEMOLITION CHARGES

(75) Inventors: Richard Andrejkovics, Blairstown, NJ (US); James Chopack, Columbia, MD (US); Herbert Brann, Frederick, MD (US); John Hopkins, Columbia, MD (US); Ronald Tobin, Burtonsville, MD (US); William Fraser, Edgewater, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/541,837

(22) Filed: Apr. 3, 2000

(51) Int. Cl.[7] ..... F42C 00/00

(52) U.S. Cl. ..... 102/200; 102/202.5; 102/215; 102/217

(58) Field of Search ..... 102/200, 214, 102/302, 202.5, 215, 217, 221

(56) References Cited

U.S. PATENT DOCUMENTS 4,576,093 A * 3/1986 Snyder
4,674,047 A * 6/1987 Tyler et al.
4,817,529 A * 4/1989 Schippers
4,869,171 A * 9/1989 Abouav
4,884,506 A * 12/1989 Guerreri
5,014,622 A * 5/1991 Jullian
5,107,765 A * 4/1992 Schippers
5,159,149 A * 10/1992 Marsden
5,427,032 A * 6/1995 Hiltz et al.
5,447,090 A * 9/1995 Adams
5,460,093 A * 10/1995 Prinz et al.
5,546,862 A * 8/1996 Schabdach
5,554,817 A * 9/1996 La Mura et al.
5,563,366 A * 10/1996 La Mura et al.
5,767,437 A * 6/1998 Rogers
5,894,103 A * 4/1999 Shann
6,000,338 A * 12/1999 Shann
6,014,932 A * 1/2000 Mardirossian
6,173,651 B1 * 1/2001 Pathe et al.
6,198,404 B1 * 3/2001 Campagnuolo et al.

OTHER PUBLICATIONS

Demolitions, Remote Activation Munitions System, (Apr. 16, 1998).*
The Voice, Remote Activation Munitions System (Nov. 21, 1997).*

* cited by examiner

*Primary Examiner*—Michael J. Carone
*Assistant Examiner*—Troy Chambers
(74) *Attorney, Agent, or Firm*—Paul S. Clohan, Jr.; William W. Randolph

(57) ABSTRACT

An apparatus for the activation of a remote device having a transmitter to generate and transmit user-set special coded signals. The transmitter has a function selector switch to select modes of operation for the transmitter. Included is also a receiver to receive the user-set special coded signals, and the receiver also has a function selector switch to select modes of operation for the receiver. The function selector switch selects the following modes of operation for the transmitter: (a) a "transmit/fire" mode that enables a fire signal to be transmitted to the receiver; (b) a "wake-up" mode that enables a set-up receiver mode for immediate firing; (c) a program mode for low power transmission of programmed codes; and (d) a "test" and operational mode that enables an operational test of the apparatus with no firing output. The function selector switch on the receiver selects the following modes of operation for the receiver: (a) receive a "wake-up" of "fire" signal; (b) actuate either an electrical excitation output or an electromechanical solenoid output; (c) provide a continuity test for a blasting cap; (d) program the receiver for receiving programmed codes; and (e) conduct operational tests of the receiver.

6 Claims, 12 Drawing Sheets

RECEIVER'S CODE SELECTOR SET TO "3"
TRANSMITTER'S CODE SELECTOR SET TO "4"

RECEIVER'S CODE SELECTOR SET TO "4"

APPARATUS FOR REMOTE ACTIVATION OF EQUIPMENT AND DEMOLITION CHARGES

BACKGROUND OF THE INVENTION

1. Field of the Invention

This invention relates to a remote control apparatus for control of,detonation of explosives or other remotely located device. In particular, the invention is particularly directed to a portable radio frequency operated apparatus that includes a transmitter and at least one receiver having multi-functional capabilities for extended range, versatility and mission capability.

2. Description of the Prior Art

Remote activation systems with radio frequency (rf) communication links between transmitter and receiver devices have been used widely in the field of military and industrial demolition:applications. In the past, demolition firing devices that generate an electrical impulse detonation signal at their output have been used to detonate explosives or actuate other devices such as smoke generators. For example, the model XM-122 is such a remote control device currently used by the U.S. armed forces, which provides remote activation of demolition charges by sending an rf-signal from a transmitter to a dedicated receiver which in turn activates a blasting cap in response to a properly coded rf-signal. An improved adaptation of the XM-122 is illustrated in U.S. Pat. No. 5,546,862 entitled "Remote control adaptor for a detonator system." Like other devices that are still in use for demolition purposes, the XM-122 is relatively large, fragile, and heavy, with a limited range and operational capability. Also, this remote detonation device has hybrid circuitry and very large high capacity batteries. The XM-122 is undesirable because of its size, power source and range limitations. The XM-122 has a nominal range of 1 km. When used over dry sand, the XM-122 has an estimated range of 3.3 km. Over frozen tundra, the estimated range of the XM-122 is 0.8 km. Additionally, the capability of the XM-122 does not allow for relay capability between multiple units as performed by the instant invention. Another limitation of the XM-122 when compared to each of the three embodiments of the instant invention's transmitter/receiver devices is that the instant invention has four unique and three common transmission codes. This means that each receiver can be programmed with seven individual codes (whereas each XM-122 receiver has one unique code). In addition, the XM-122 and similar prior art devices use hybrid circuits, which are labor-intensive and expensive to produce.

Most remote actuation apparatus are rf-sensitive at the receiver. To account for spurious rf-signals, a high-powered transmitter is typically required to make it insensitive, which a portable battery operated system cannot do. Inventions that deal with environmentally insensitive explosive detonation devices include U.S. Pat. No. 5,488,908 entitled "Environmentally insensitive electric detonator system and method for demolition and blasting." This teaching describes an electrically activated detonator apparatus that includes a relatively insensitive initiating charge in proximity to the main explosive charge; circuitry having input components to receive an input firing pulse; and output components to provide, through arbitrarily long wires, a high voltage that cause ignition of the main explosive charge. Problems with this system include a lack of range, the need for long wires and is lacking in multi-functional capabilities.

The present invention overcomes these problems and provides an effective, safe, and versatile system to remotely control the detonation of demolition charges and remote operation of equipment, such as beacons, laser markers, radios, weapons and other components that are remotely located.

SUMMARY AND ADVANTAGES OF THE INVENTION

The invention relates to an apparatus comprising transmitter and receiver devices in three embodiments, whose receivers have controlled outputs of either a) electrical excitation, b) control of a mechanical actuator similar to that shown in U.S. Pat. No. 5,546,862, which is hereby incorporated by reference or c) detonation of an explosive. The invention includes circuitry for electrical power conservation wherein each transmitter and receiver is portable and uses batteries, an rf-circuit that reduces rf-susceptibility of spurious environmental signals and increases safety to personnel using the apparatus by enhanced multi-functional encoding capability to actuate the unit. Methods of use include a wide range of military applications, as well as civilian applications such as avalanche control, forestry service, mining operations and structural demolition as well as others. A transmitter and a first embodiment of the receiver can be used in a relay mode for extended operational range where the receiver is coupled to a transmitter in a daisy-chain repeater fashion. A single transmitter can selectively actuate any combination of multiple receivers using a multiple coding schemes (three are common and four are unique receiver programmable).

Accordingly, several advantages of the present invention are:

(a) To provide a detonation/actuator apparatus that includes a microprocessor-based transmitter and receiver units that each include functional capability of a coding scheme for operational flexibility and enhanced safety. Using this feature, each receiver can be programmed by an rf-link to a set of unique codes assigned to each transmitter. The receiver responds to a common coded signal from any one transmitter or responds only to a transmitter-unique coded signal, thus only one receiver can be targeted for actuation by a transmitter in a multi-receiver set-up. Thus, the operator can use combinations of multiple receivers and transmitters or retain single transmitter function for safety: of personnel.

(b) To provide a detonation/actuator apparatus that can be used in harsh environments wherein each receiver includes a crystal filter that provides high out-of-band rejection while tolerating impedance variations due to antenna placement. The filter is combined with a low power FM detector circuit that provides an FSK signal while maintaining high-sensitivity at a low power consumption rate using a commercially available battery power source (for example, a 9-volt battery).

(c) To provide a detonation/actuator apparatus that includes a housing design that affords varied exposure while allowing for multi-functional capabilities in harsh environments such as submergence in saltwater up to depths of 66 feet and use in harsh climatic temperature extremes between −25 and 140 degrees F.

(d) To provide a detonation/actuator apparatus that includes capabilities that allow for a daisy chain relay mode where one receiver is coupled to a transmitter in a repeat fashion to enable many km range relay of a control signal from a master transmitter.

(e) To provide a detonation/actuator apparatus that includes capabilities that allow for a data link test capability between transmitters and unarmed receivers.

(f) To provide a detonation/actuator apparatus that includes capabilities that allow for a LED user feedback of all operations compatible with night vision equipment.

Still further advantages will become in view of the ensuing detailed description. For a better understanding of the present invention, together with other advantages thereof, reference is made to th e following description taken in connection with the accompanying drawings.

BRIEF DESCRIPTION OF THE DRAWINGS

FIGS. 2*a*, 2*a*-1, and 2*b* illustrate in isometric views the receiver in front and rear views in a first and second embodiment.

FIGS. 6*a*, 6*a*-1, 6*a*-2, 6*b*, 6*b*-1, and 6*b*-2 are flow diagrams of the programming used by the transmitter and receiver devices.

In the drawings, like numerals indicate like parts.

DETAILED DESCRIPTION

The use of the present invention includes a transmitter and one or more receivers with various optional components and features. The apparatus comprises five components: a transmitter, an auxiliary power source and three embodiments of the receiver: electrical, electromechanical & explosive outputs. Each transmitter contains three common firing codes and four unique codes, which can be transferred to the receivers via a low power rf-signal. A full power range data link test between the transmitter and the unarmed receivers can be performed. An automatic self-test is contained within each transmitter and the receivers. All operations are conveyed to the user via an LED, which is compatible with night vision goggles. A continuity circuit test has been built into the first embodiment of the receiver. The transmitter and receiver devices include a housing design that provides operational capabilities in harsh environments, including use in saltwater to a depth of 66 feet, in a surf zone, and over a temperature range between −25 to 140 degrees F. The apparatus provides the user with an effective, safe, affordable and high quality multi-use system to perform a wide variety of required missions.

Transmitter

Figure 1B:
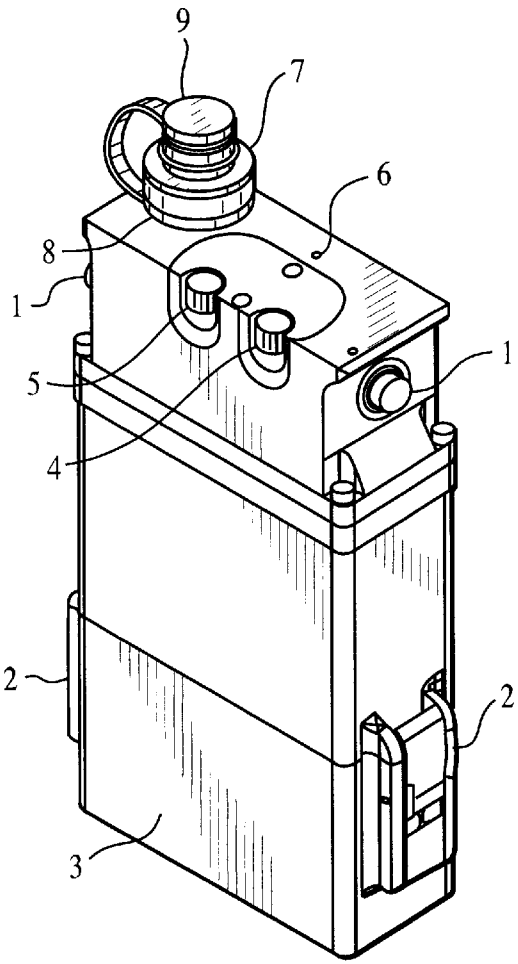
FIGS. 1*a* and 1*b* of the accompanying drawings diagrammatically illustrate in isometric views the transmitter.
Figure 1A:
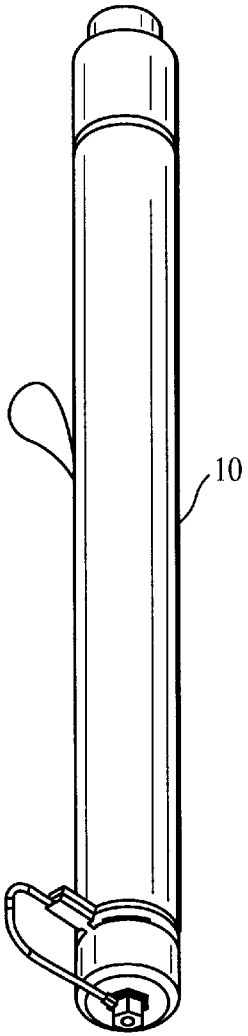
Figure 1C:
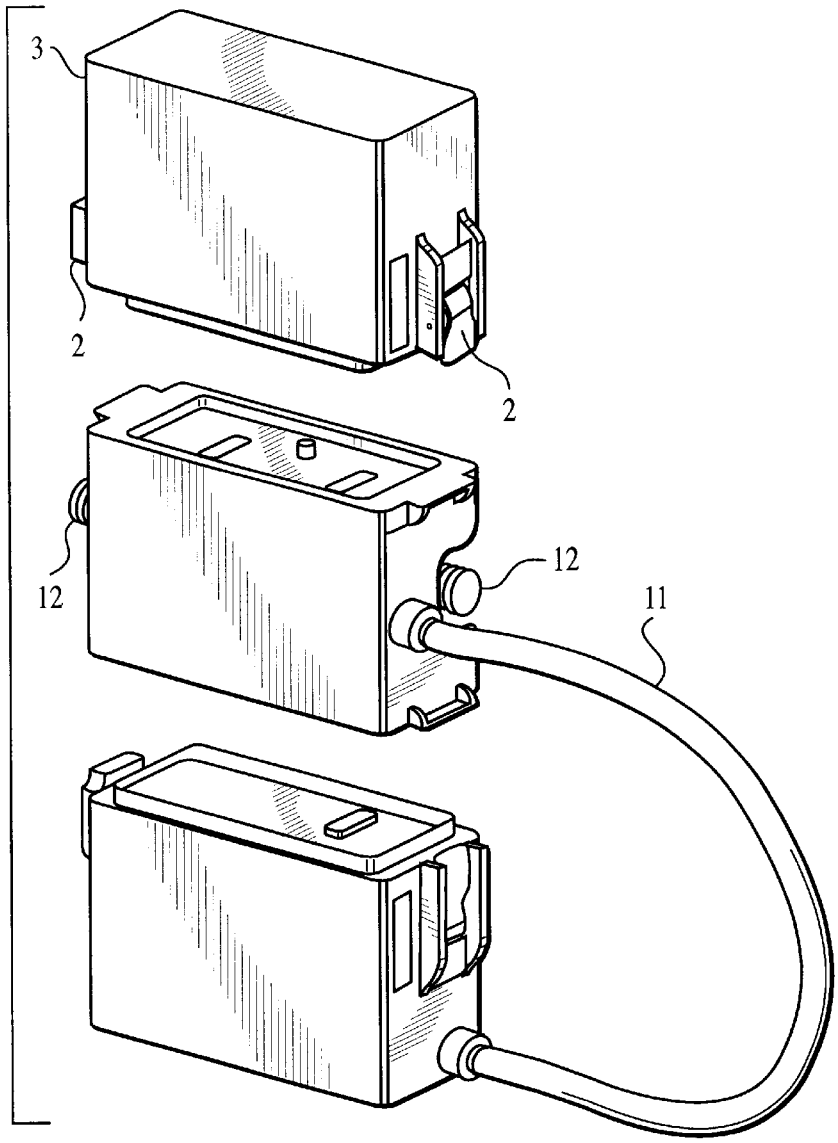
FIGS. 1*c* and 1*c*-1 illustrate in isometric views the auxiliary power source.

FIGS. 1*a*, 1*b* and 1*c* show the antenna, transmitter and auxiliary power devices in exemplary form. The transmitter body is shown and housed in an anodized aluminum enclosure. The housing of the transmitter is a casting of aluminum, which next has aluminum-ions coated on the external surface. Then a hardened anodized surface is deposited there over for rugged environmental use. For harsh environments where used, the transmitter housing can be equipped with as many as seventeen water-tight seals for transport through underwater conditions such as surf. A typical transmitter as shown has an enclosure size of approximately 28-in$^3$.

The transmitter can generate user-set special coded signals and radio transmit them to any of the receivers which have been set by the user to respond to these signals. With line-of-sight transmission, the transmitter can actuate a receiver within 2.0 km. The antenna shown in FIG. 1*a* (or field expedient 10-foot piece of wire) must be attached to transmitter's antenna post to enable transmission. The transmitter is powered by user-installed standard 9-volt batteries (alkaline). The transmitter typically weighs no more than several pounds. The transmitter can be connected to an auxiliary power source that can hold and retain up to seven additional 9-volt batteries for additional power capability. Maximum range is obtained by using all seven batteries along with four batteries in the transmitter device.

As shown in FIG. 1*b,* the two transmitter buttons 1, are push buttons that are located on each side of the transmitter to enable transmission to the receivers. The two clasps 2 are snap-latches latches to secure a sealed battery compartment 3 to the transmitter body. The code selector switch 4 is an eight position rotary switch that selects preprogrammed and coded signals that can be transmitted. A function selector switch 5 is also an eight position rotary switch that powers-up/control/select transmitter's modes of operation. An indicator light 6 shows the transmitter's status (off, steady, regular or irregular blink). A knurled nut 8 for the antenna, which allows for attachment of ground plane wire. An antenna base 7 allows vertical mounting of a detachable antenna or an expedient 10-foot piece of wire. An antenna base protective plug 9 allows keeping the antenna base female threads clean and to secure an expedient wire antenna. The antenna 10 in FIG. 1*a* attaches to the main body of the transmitter.

As illustrated by way of example, the code selector switch 4 (eight position rotary switch) has four unique factory-set transmitter codes that are programmable. At certain switch positions, there are three common codes of the transmitter and all receivers.

The function selector switch 5 preferably includes: a) a "transmit/fire" position that enables a "fire", signal to be transmitted to the receiver(s); b) a "wake-up" function that enables a set-up receiver mode for immediate firing; c) a program mode for low power transmission of programmed codes and d) a "test" and operational mode that enables an operational test of the apparatus with no firing output.

The battery retainer compartment 3 shown detached in FIG. 1*c* has clasp 2 that enables attachment to the main body of the transmitter that can hold up to four batteries. This unit can also have a cable 11 that allows multiple compartments to be connected together for greater battery power capability using a cable 11. The terminals 12 allow for a receiver to be connected to a transmitter for relay operation as discussed below. In the preferred mode, up to eleven batteries can be used to provide a minimum range of 5-km.

Figures 1, 1C:
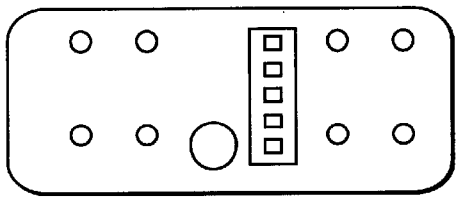

FIG. 1*c*-1 is a bottom view of the battery retainer compartment 3.

Receiver

Figure 2B:
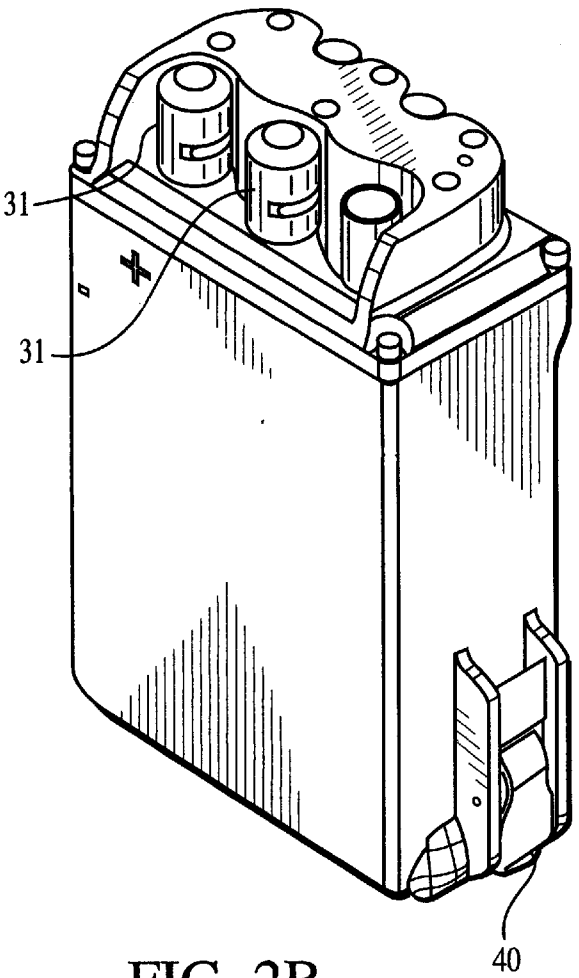
Figure 2A:
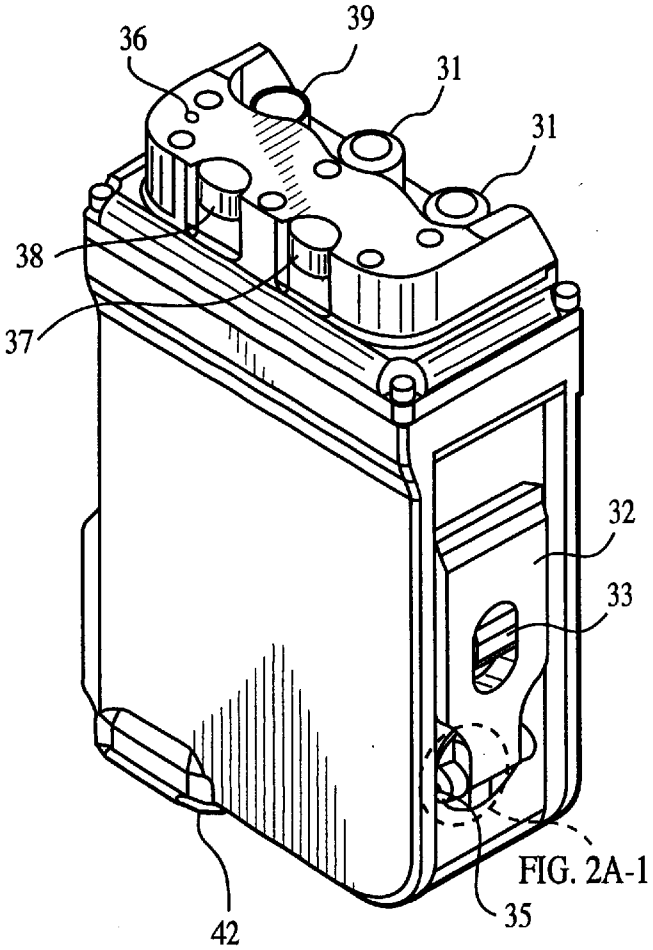
Figures 1, 2A:
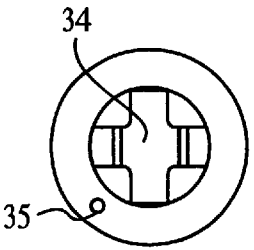

FIGS. 2*a* and 2*b* show the receiver in first and second embodiments, both in front and rear views. Theses embodiment includes an electrical excitation output at terminals 31, which can be connected to firing wires or blasting caps and/or other devices. Up to four blasting caps can be connected to a 100 feet of wire at the output binding post of the receiver of the first embodiment. The second embodiment actuates an electromechanical solenoid adaptor An arming tab 32 enables the receiver to perform a continuity test. A lock button 33 unlocks the arming tab to enable the receiver. A rotor 34 includes a rotating base of arming tab 32. An indicator mark 35 is on the housing to indicate safe, continuity test or arm. An indicator light 36 provides the status of the receiver whether it is off, steady, or blinking. A code selector switch 37 is a rotary switch that selects the receiver's code. A function selector switch 38 provides eight position rotary switch to power-up/control/select receiver's modes of operation. An antenna terminal 39 connects to any wire at least ten feet in length. A battery cover 40 secures and seals the battery compartment to the receiver. A bump 42 is part of the housing to distinguish the polarity of the battery. The code selector switch 37 has a comparable coding function as discussed above with the transmitter with four unique codes which do not work unless programmed by a transmitter and three common codes that are common to all transmitters and all receivers.

FIG. 2*a*-1 is a blown up view showing the rotor 34 and indicator mark 35 for the receiver shown in FIGS. 2*a* and 2*b*.

The function selector switch 38 has several markings that preferably include: a) receive a "wake-up" or "fire" signal; b) actuate the electromechanical actuation device such as that taught in U.S. Pat. No. 5,546,862 which teaches of a double pole, double throw switch that can be used for activating another device, which is hereby incorporated by reference (other devices include an attached shock tube of an MDI device); c) provide a continuity test for a blasting cap; d) program receiver for receiving programmed codes; and e) conduct operational tests of the receiver with indicator lights shown.

The receiver of this embodiment can actuate, via output terminals 31, up to four user attached electric blasting caps when it receives a specific, coded radio signal. In lieu of blasting caps, it can also be used to repetitively turn on and off beacons, laser markers, and other related devices. Receiver can be set to respond to any one of three common coded signals, which can be transmitted by any transmitter. It can be programmed by a specific transmitter to respond to one of four unique coded signals that can be generated only by a specific transmitter. The receiver is capable of operating blasting caps through up to 100 feet of common type two-conductor wire. An additional 10-foot piece of wire must be attached and rigged as an antenna since unit has no internal antenna and best range is gained by use of such an external antenna. Receiver is turned on and its operational mode set with its function selector switch. Function selector switch can be set to allow receiver to be programmed to respond to a specific transmitter to do an operational test and even to test attached blasting cap circuit in addition to the primary function of firing blasting caps. The arming tab on its side starts a five-minute arming delay timer that does not allow receiver to actually function until the five-minute arming delay has elapsed. The receiver is reusable if it is protected from the explosives it initiates. Receiver is equipped with a status indicator light and a sealed compartment for the single 9-volt battery used to power it. A fresh alkaline or lithium battery set allows a receiver to remain operational for 15 days. With batteries installed, the receiver weighs approximately 1.3 pounds. The receiver will actuate the electrical output circuit (firing) when it receives the proper coded signal from a transmitter. The receiver has two modes of firing selectable from the transmitter as follows:

The immediate firing mode is obtained by the operator transmitting a wake-up signal before desired time of immediate firing. This wake-up signal causes receiver to listen constantly for fire signal up to 5 minutes instead of its normal pulse listening state, which saves battery power. (The 5-minute safe separation time is still required.) Wake-up signal must be retransmitted after five minutes to retain immediate fire capability.

A 4-second delay will occur in normal firing mode since it uses a pulsed type of "listening" to save battery power (a 4.1 to 12-second delay could occur in adverse situations).

The second embodiment of the receiver is similar to the first, discussed above, in features and functions except that it actuates an electromechanical solenoid adaptor such as that taught in U.S. Pat. No. 5,546,862 as discussed above, instead of providing electrical power to actuate attached electric blasting caps or other devices. The electromechanical actuator can be a solenoid that moves an integral mechanical arm which can provide a physical pull (or push) of approximately 10 pounds to function any compatible attached device. Several integral clamps are provided on receiver's surface for this purpose.

Figure 3B:
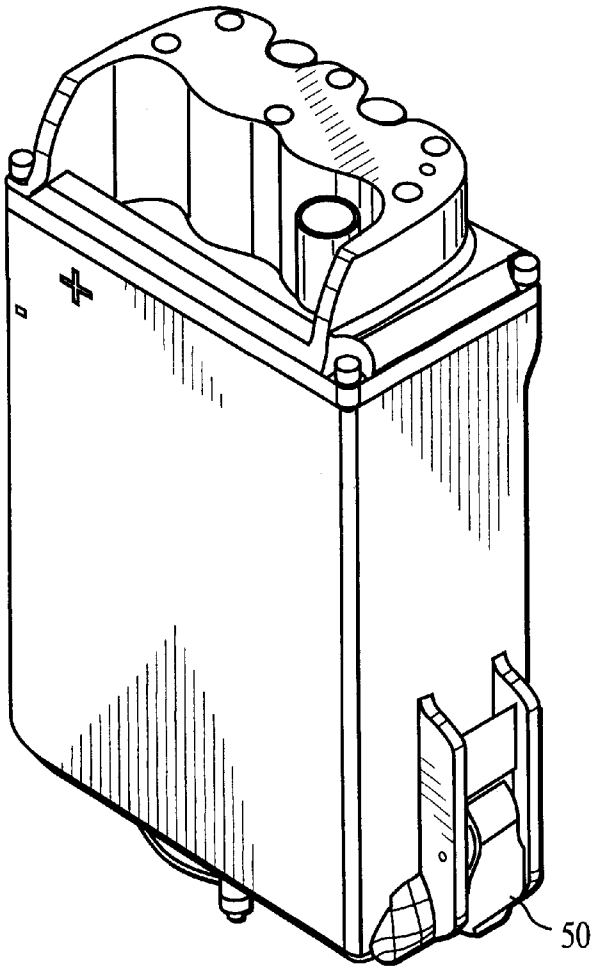
FIGS. 3*a* and 3*b* illustrate in isometric views the receiver in front and rear views in a third embodiment.
Figure 3A:
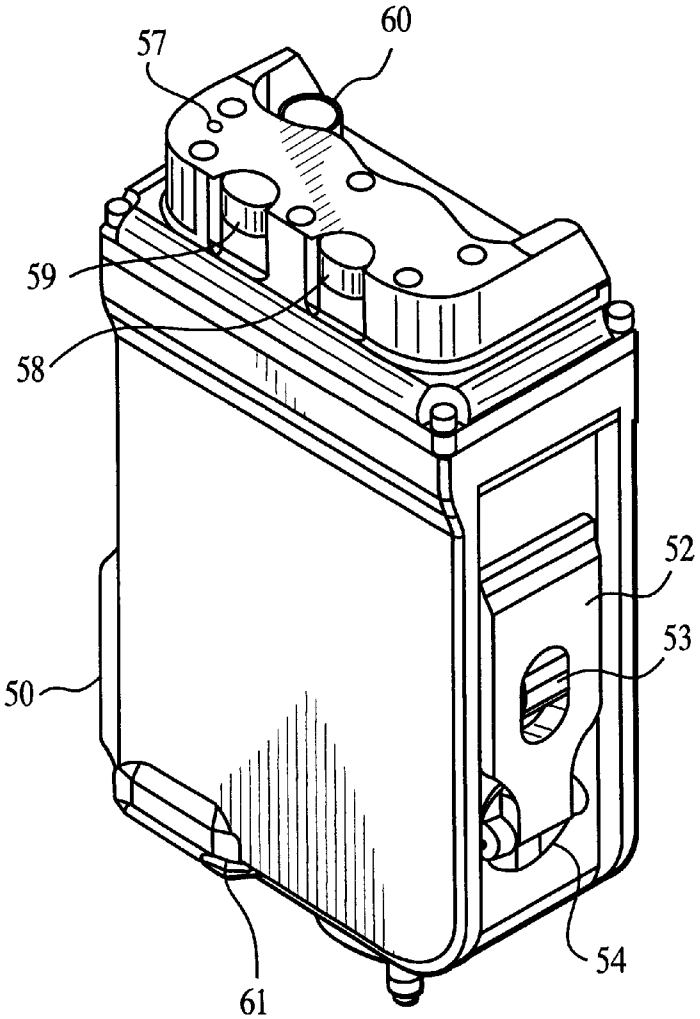

FIGS. 3*a* and 3*b* show the receiver in a third embodiment in front and rear views. This embodiment has an explosive output which can initiate a mechanical blasting cap or a "booster cap" which is essentially a blasting cap shell filled with secondary explosive such as Comp-A5, PETN, PBX-9407, etc. Ordnance devices typically incorporate an explosive "load" or charge, or alternatively may be in the form of two or more explosive co-reactants, in the case of binary or multi-component explosive systems, together with a firing or detonation mechanism, which may for example include a blasting cap, time delay fuse, firing pin, impact ignition device, stab action element, timer, pressure-sensitive electrical resistance heating element, or other subassembly or structure which ignites or detonates the explosive charge.

This embodiment of the receiver contains a fire set that includes an initiating charge of an environmentally insensitive explosive material, such as hexanitrostilbene, adjacent which is an exploding foil initiator (EFI). In use, safe/arm circuitry of the receiver outputs DC and AC voltages, which is received by the fire set. These voltages charge a capacitor. When the voltage reaches a predetermined level, a vacuum switch closes, causing capacitor to discharge through an exploding foil initiator, thus detonating initiating charge.

An arming tab 52 enables the receiver to arm the receiver. A lock button 53 unlocks the arming tab 52 to enable the receiver. A rotor 54 includes a rotating base of arming tab 52 (indicates safe or arm). An indicator light 57 provides the status of the receiver whether it is off, steady, or blinking. A code selector switch 58 is a rotary switch that selects the receiver's code. A function selector switch 59 provides eight position rotary switch to power-up/control/select receiver's modes of operation. An antenna terminal 60 connects to any wire at least ten feet in length. A bump 61 is part of the housing to distinguish the polarity of the battery. The code selector switch 58 has a comparable coding function as discussed above with the transmitter with four unique codes which do not work unless programmed by a transmitter and three common codes that are common to a transmitter and all receivers. A battery cover 50 secures and seals the battery compartment to the receiver.

This embodiment of the receiver is similar to the first two embodiments in features and functions except that it is a one-shot device that actuates an explosive initiator in its integral blasting cap nipple instead of providing electrical power to function attached electric blasting caps. The initiator functions a single non-electric blasting cap (attached by the operator). Blasting cap nipple assembly allows water tight securing of the cap with its integral securing nut. The securing nut is equipped with standard priming adapter male-threaded protrusion so the whole receiver may b e easily connected to most demolition charges and devices. As an additional feature, this embodiment can include a training receiver that uses a light to indicate firing.

Figure 4:
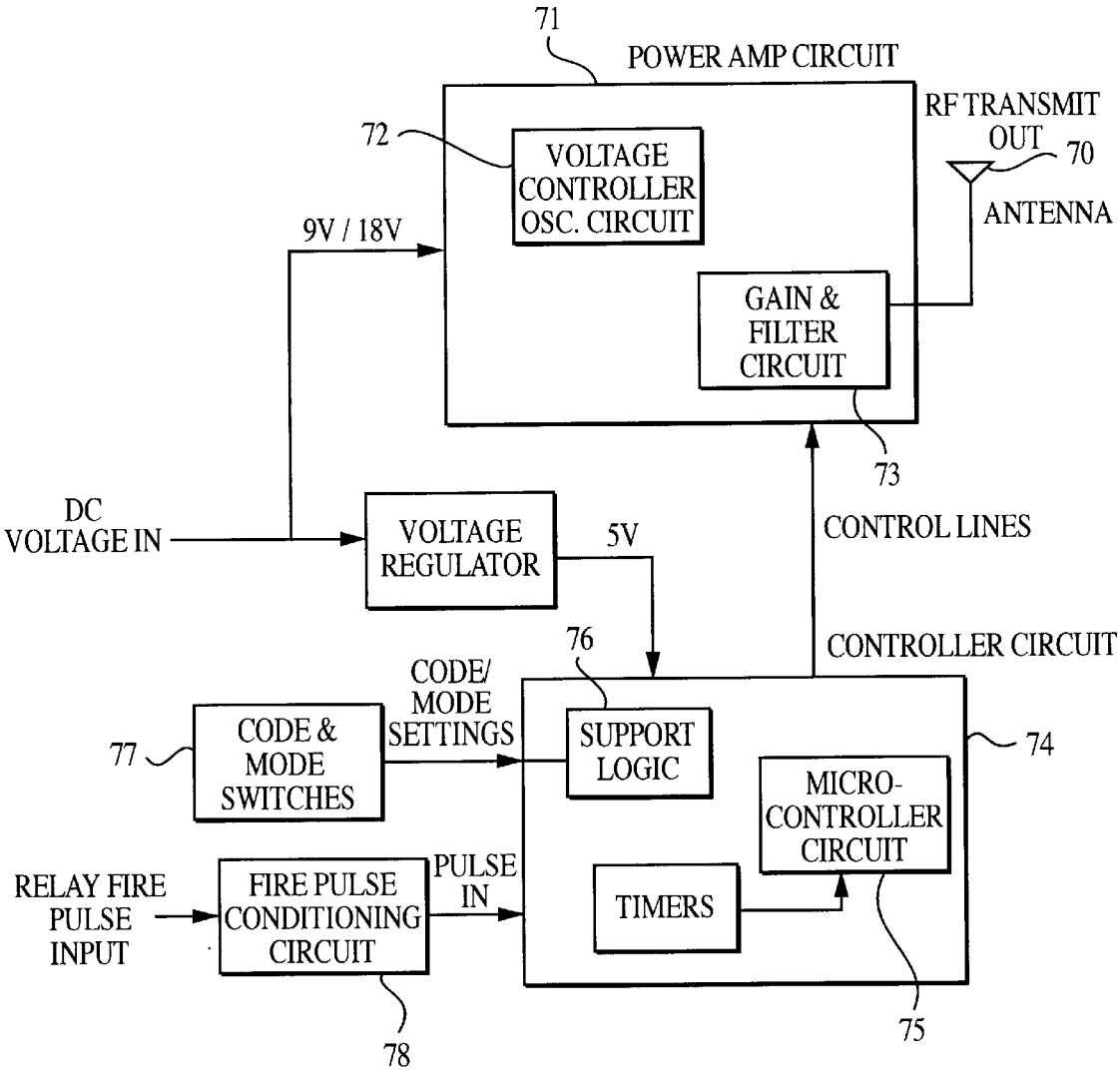
FIG. 4 is a block diagram of the electrical components of the transmitter device.

FIG. 4 shows a block diagram of the electrical circuits and signal flow of the transmitter device. The illustrated circuit device shall be further described in the following with respect to its basic configuration and function.

The device includes an RF transmit antenna output 70 that is connected to the power amplifier circuit 71. The input power to this circuit can be either 9-volts or 18-volts, depending upon required operational range of signal code transmissions. The voltage control oscillator circuit 72 provides high stability and enables proper operation over the range of operating temperatures. The gain and filter subcomponents 73 boost signal power for signal transmissions. The controller circuit 74 includes a microprocessor controller 75 and support input signal logic 76 for control of: a) user interface which reads code and mode select rotary switches 77; blinks LED to indicate transmitter operation status; b) data handling by interfacing with the power amp circuit 71 to transmit a bit stream of codes; c) controls the transmission cycle of the power amp circuit for power conservation; and d) receives the pulse in when used in relay fire pulse input in a daisy relay mode of operation as discussed below.

The input code/mode switches 77 are each eight position rotary switches located on the transmitter and receiver devices as discussed above for enabling several subroutines within the microprocessor. The fire pulse conditioning circuit 78 functions to support the daisy chain relay mode of operation as discussed below. This circuit effectively rejects false triggers and environmental noise and conditions signals that are input to the controller 75.

Figure 5:
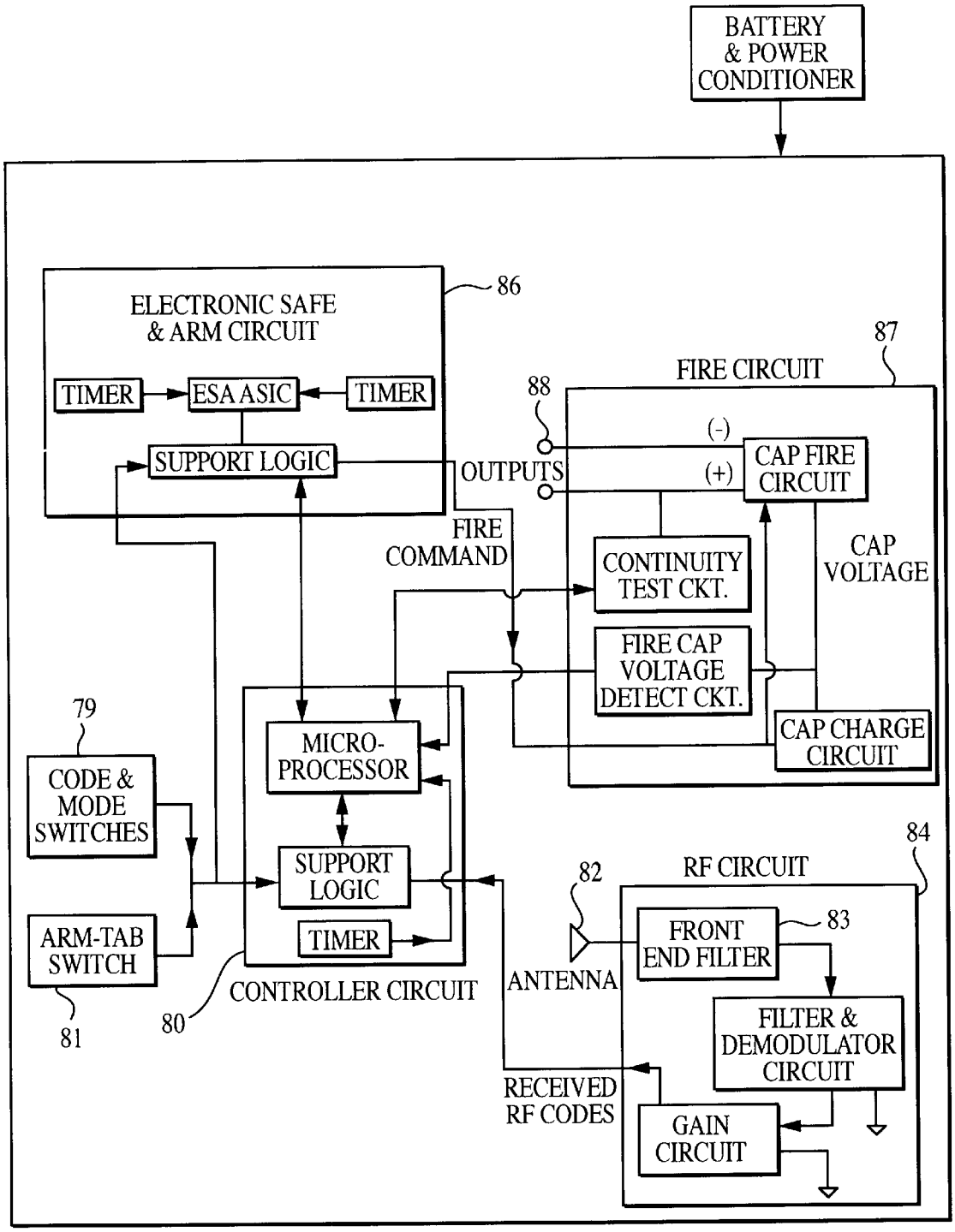
FIG. 5 is a block diagram of the electrical components of the receiver device.

FIG. 5 shows a block diagram of the electrical components and signal flow of the receiver. The illustrated circuit device is further described in the following with respect to its basic configuration and function. A controller circuit 80 includes a microprocessor controller and an input signal logic for control of: a) user interface which reads code and mode select rotary switches; blinks LED to indicate status of operation; and looks at the arm tab; b) data handling by interfacing with the rf-receiver circuit 84 to interpret bit stream and handles the codes of programming and data storage; c) controls the duty-cycles of the RF-circuit for power conservation; and d) controls and monitors the required output functioning of each of the three receiver embodiments (the first embodiment being control of charging of the firing circuits on proper command by providing: the final inputs for arming switches, which charges the firing capacitor and monitors the charge state of the firing capacitor., the second embodiment being actuation of an electromechanical device such as a relay or push-pull solenoid and the third embodiment being initiation of firing of an EFI component residing within the receiver).

The input power to the receiver is a 9-volt battery. The controller circuit 80 includes a microprocessor that includes a coding sequence for extensive operational flexibility using the code and mode switches as discussed above, which are eight position rotary switches 79 for mode and code functions. Using this feature, one or more receivers of the present invention can be programmed by a single transmitter to either respond to a common coded signal from any of the transmitters or to respond only to a transmitter-unique coded signal. An arm-tab switch 81 allows a 5-minute delay in arming of the receiver to allow personnel time to get away from the receiver prior to it being capable of receiving a detonation command.

The electronic safe and arm (ESA) circuit 86 function is to a) read the arm tab switch 81; b) provide a five minute safe separation timer and c) to shutdown on re-safing of the arm tab. In the first receiver embodiment, the ESA circuit 86 is designed to control an in-line system and may include a DC-DC converter in the fire circuit 87 to produce higher output voltages at the output terminals 88 using either a capacitor charging circuit when using the first embodiment of the receiver or a higher voltage (kV range to control actuation of an EFI device as used in the third embodiment of the receiver). The ESA circuit is typically implemented using an application specific integrated circuit (ASIC) with necessary support logic for input signals for optimal safety to personnel in the field to allow safe separation time of five minutes after turning of the arm tab switch 81. After safe separation, the outputs are latched and arm switches are enabled.

An antenna 82 inputs a received signal to a specially designed crystal filter 83 of an rf circuit 84, which provides extremely high out-of-band rejection while tolerating impedance variations due to antenna placement. The rf circuit 84 includes an FM detector circuit that provides signal decoding at low power consumption while maintaining high-sensitivity. In the first embodiment of the receiver, the output from the fire circuit section 87 is connected to both the microprocessor controller circuit 80 and the electronic safe and arm circuit 86.

Figures 1, 2, 6A:
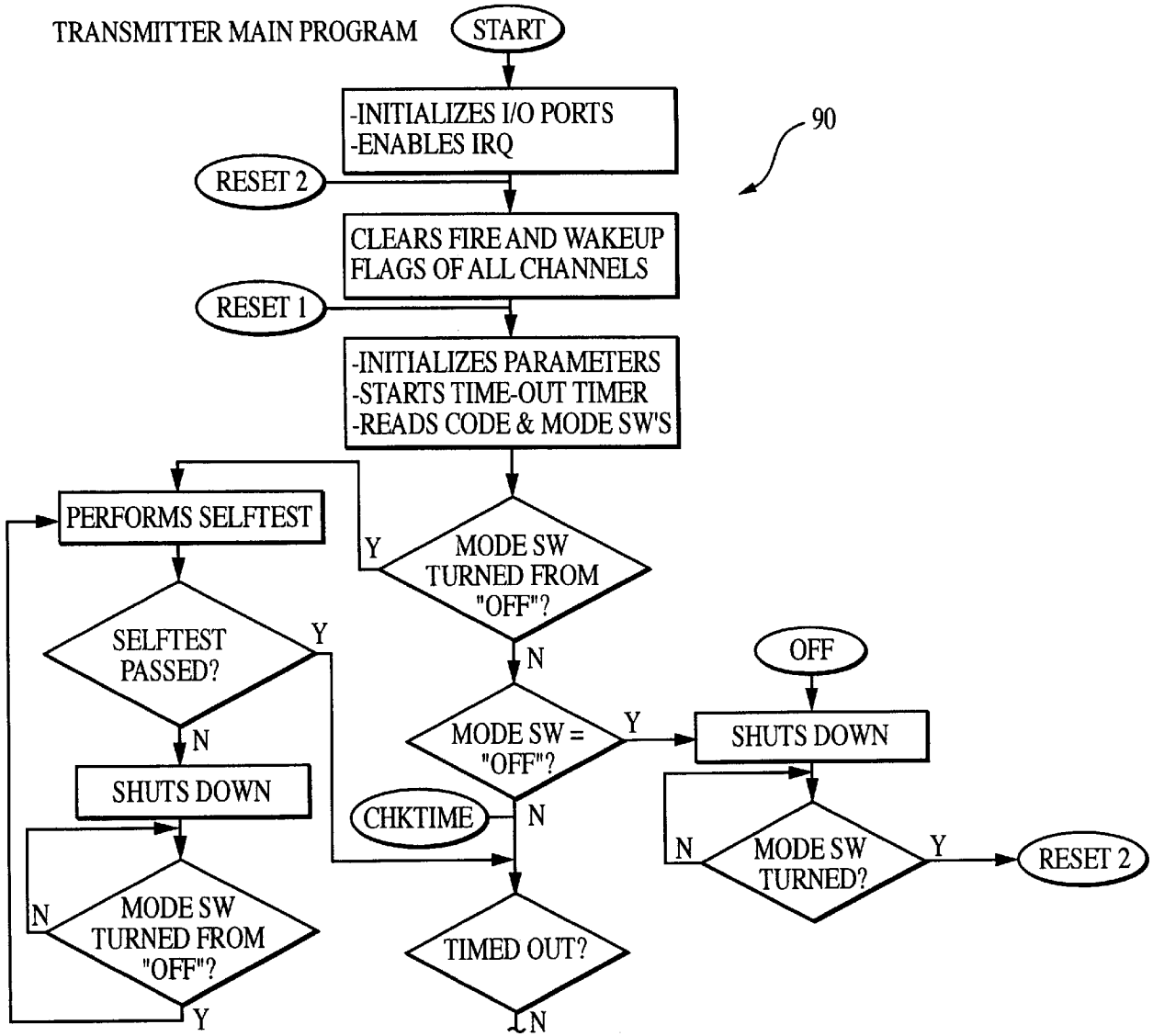
Figures 2, 6A:
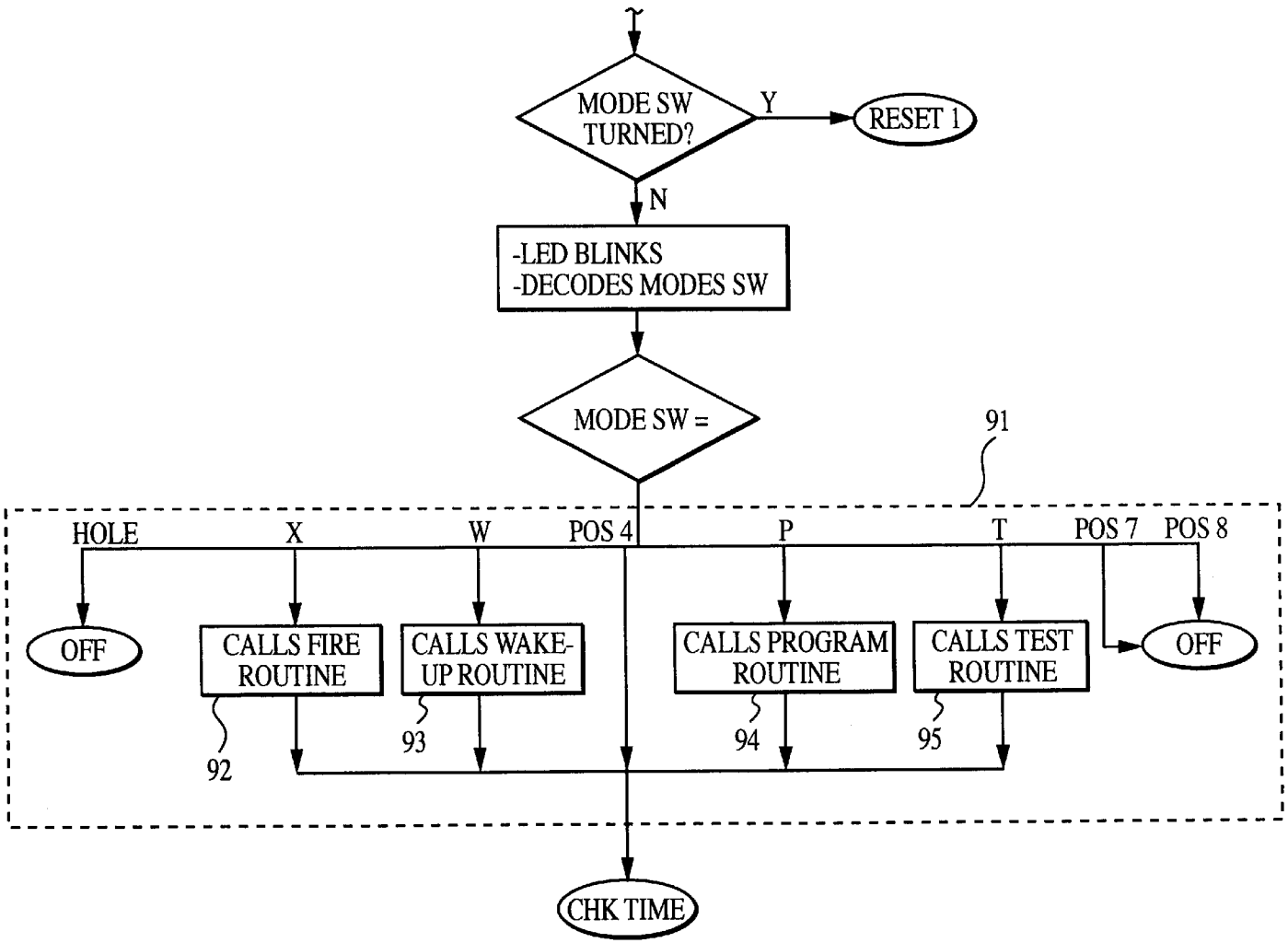

While FIG. 6*a* comprises FIGS. 6*a*-1 and 6*a*-2 in the drawings to enable the entire flow diagram 90 to be depicted, for discussion purposes the flow diagram 90 will be referred to as shown in FIG. 6*a* since it is a single flow diagram.

FIG. 6*a* is a flow diagram 90 of the programming used by the transmitter device. The initialization requires reading of mode and code switch positions. Depending upon the mode switch position, various subroutines are called to implement the functioning of switch position 91. The X position calls the fire routine 92 and will trigger whether an alert code has been sent and loads the transmission code stored in the processor 75 and turns on the rf-power amp circuit 71. The W position 93 is the wake-up routine that will trigger whether an alert code has been sent and loads the transmission code stored in RAM in the processor. 75 and turns on the rf-power amp circuit 71 to send the wake-up code. The P position is the transmitter program routine, which turns on the RF amp circuit 71 and sends four unique codes twice and all seven codes once. The T position 95 is a test position that loads code from ROM in processor 75 and turns on the RF power amp circuit 71 and sends selected code once followed by code 0.

Figures 1, 6B:
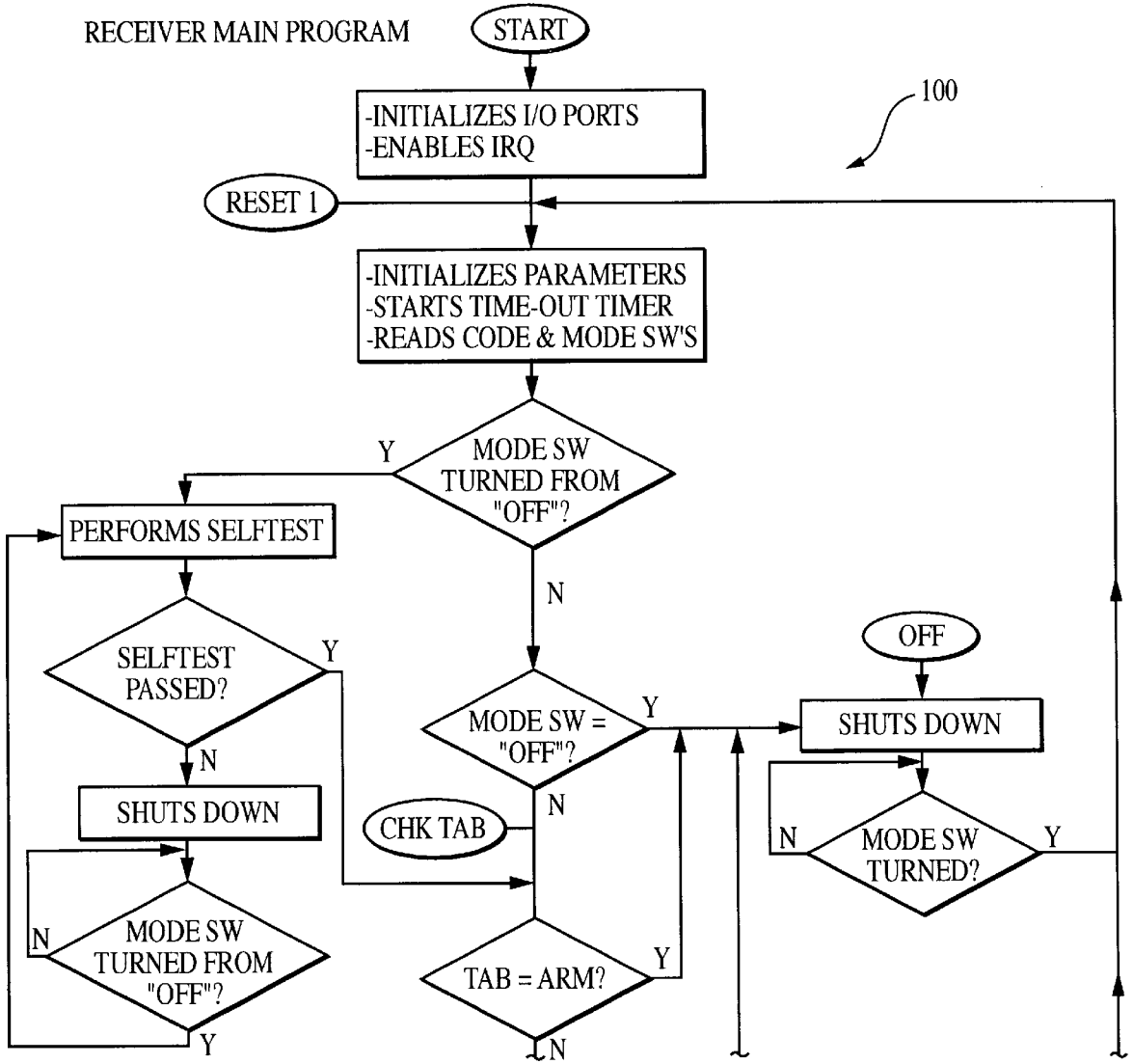
Figures 2, 6B:
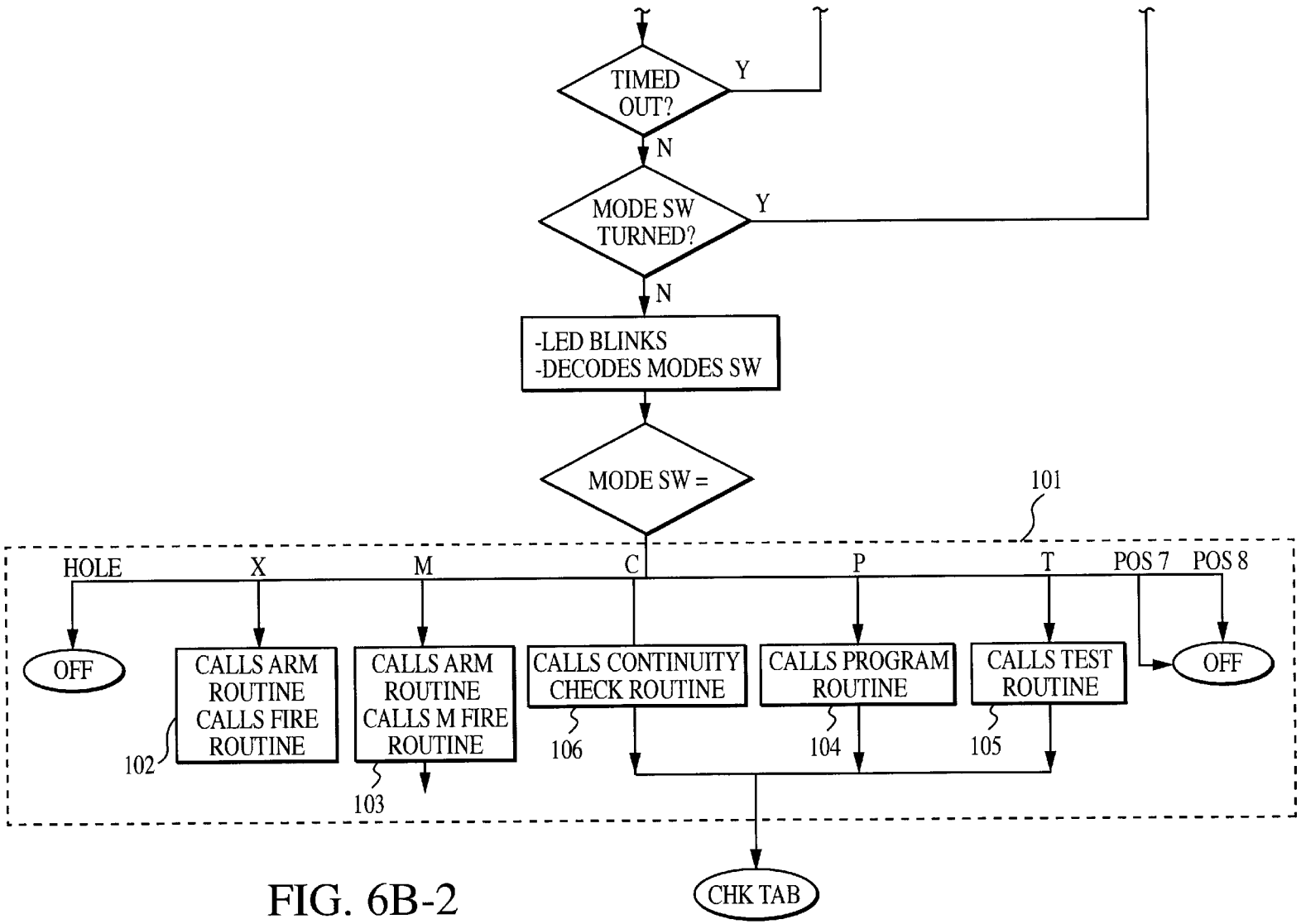

While FIG. 6*b* comprises FIGS. 6*b*-1 and 6*b*-2 in the drawings to enable the entire flow diagram of the receiver 100 to be depicted, for discussion purposes it will be referred to as shown in FIG. 6*b* since it is a single flow diagram.

FIG. 6*b* is a flow diagram of the programming used by the receiver device. The initialization requires reading of mode and code switch positions and checks to see if a tab switch condition has occurred. Depending upon the mode switch positions; various subroutines are called to implement the switch position functioning 101. The X position 102 calls the receive and decode routines for normal and immediate firing of electric blasting caps and other electronic devices. The M position 103 calls the receive and decode routines for normal and immediate firing of an attached electromechanical device or MDI (shock tube) initiator. A P position 104 calls a receive routine to receive codes 1 and 2, checks that a code is received twice and then stores the codes 1 and 2; then calls receive routine to receive codes 3 and 4 and does the same check and storage of these codes, then finally calls the receive routine to receive routine to receive all unique codes. Then the receiver checks to see whether all proper codes are received. A T position 105 is the operational test routine, which verifies the proper programming of the selected unique code and that all rf circuitry is operational. A C position 106 sets the done flags and enables the check circuit and determines whether good continuity exists in the attached blasting caps and wire connected to the output binding posts.

Figure 7:
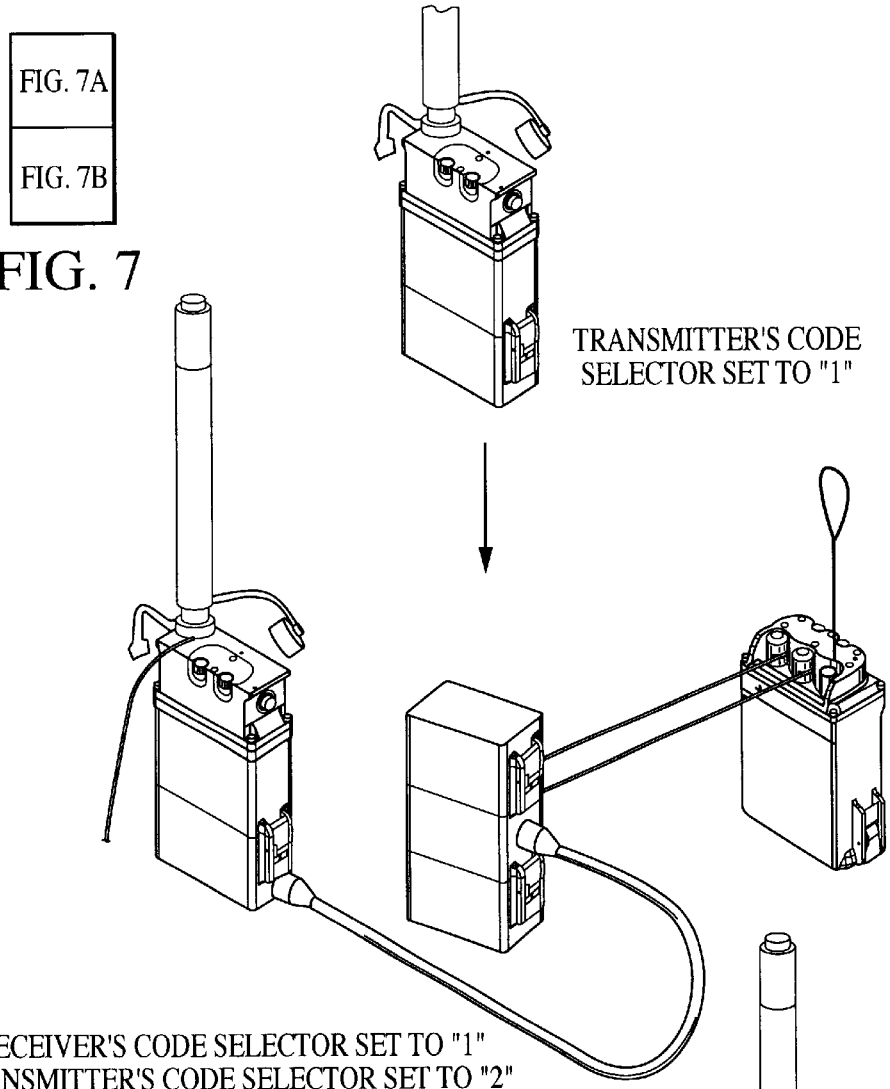
FIGS. 7, 7*a*, and 7*b* are schematic of the daisy chain method of using the transmitter and receiver in relay operation for extended apparatus range.
Figure 7A:
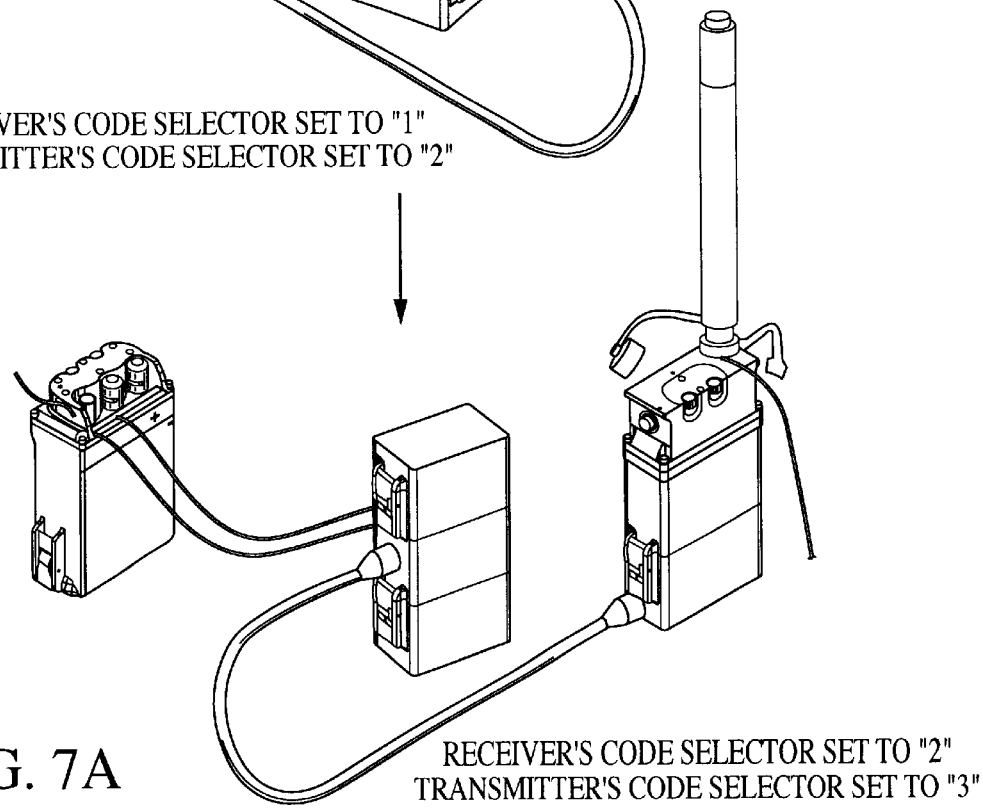
Figure 7B:
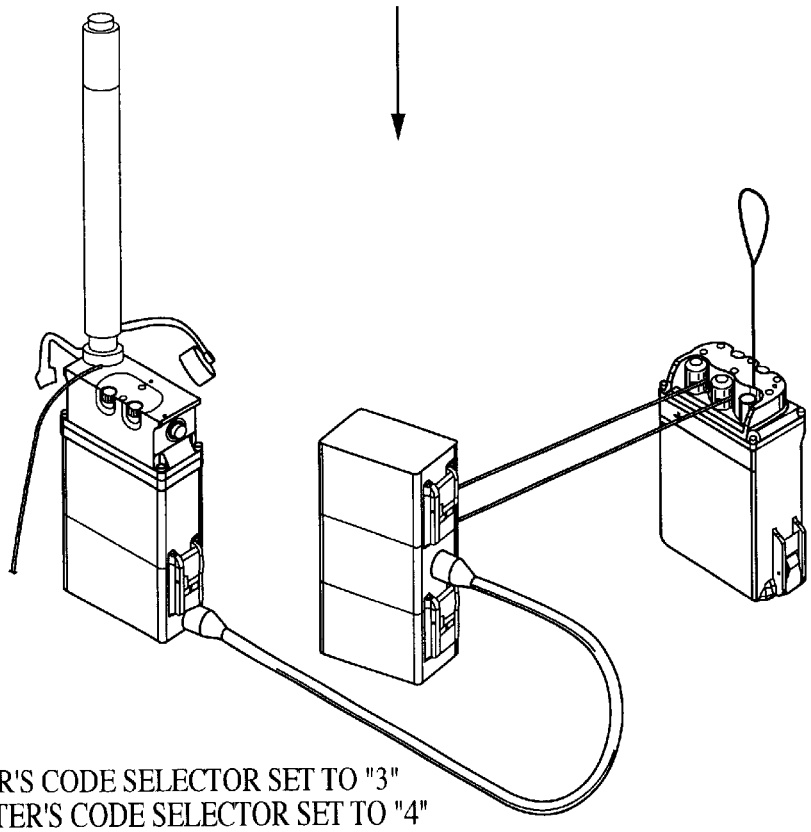
Figure 7B:
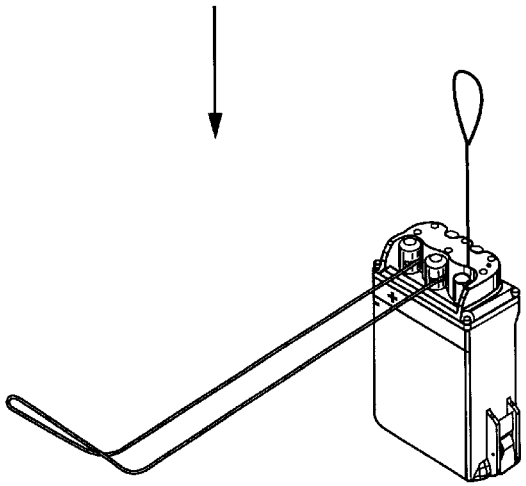

While FIG. 7 comprises FIGS. 7*a* and 7*b* in the drawings to depict the daisy chain operation, for discussion purposes it will be referred to as shown in FIG. 7 since it is a single method of operation.

Method of Use

FIG. 7 illustrates a daisy chain method of using a transmitter and a receiver in relay mode of operation for extended range of use. The daisy chain relay mode of operation is where one receiver is coupled to the transmitter in repeat fashion at multiple relay stations to increase transmission distances greater than a 5-km range wherein each receiver and transmitter are hooked together to form a repeater. The repeater will transfer the information to another receiver further down the line (say, 10 km). This procedure could be repeated ad infinitum to long distances as long as there exists a line of sight (LOS) among the equipment. For non-LOS situations, the repeater provides communication transmissions on the other side of an elevation, which would not otherwise be possible. To set up a relay unit, select a code on the firing transmitter (e.g. "1"). The relay station consists of a receiver (also set to "1") and a transmitter (code selected to "2"). At the relay station, both transmitter and receiver are connected through the battery retainer (FIG. 1*c*). At the target, the receiver code is set to code "2." The target receiver is connected to an electric detonator.

While a specific embodiment of the invention has been shown and described in detail to illustrate the application of the principles of the invention, it will be understood that the invention:may be embodied otherwise without departing from said principles.

We claim:

1. A system for the activation of a remote device, comprising:

a plurality of transmitters, each transmitter having a means for generating and transmitting via an antenna a user-set special coded signal, the special coded signal selected from one of a first group of common coded signals for the plurality of transmitters or a second group of unique coded signals for each transmitter, each transmitter having a function selector switch to select modes of operation for the transmitters, wherein a signal representing the selected mode of operation is transmitted in association with the user-set special coded signal;

a power source for each of the transmitters;

a plurality of receivers, each receiver having a means to receive the user-set special coded signals from the transmitters, wherein each receiver is programmed to receive either one of the common coded signals from the plurality of transmitters or a unique coded signal from one of the transmitters, and each receiver having a function selector switch to select modes of operation for the receiver for producing a receiver output signal to activate a remote device upon receipt of a special coded signal; and a power source for the receiver.

2. An apparatus for the activation of remote device, comprising:

a transmitter having a means for generating and transmitting via an antenna user-set special coded signals, the special coded signals selected from a first group of common coded signals and a second group of unique coded signals for the transmitter, the transmitter having a function selector switch to select modes of operation for the transmitter, wherein a signal representing the selected mode of operation is transmitted in association with a special coded signal;

a power source for each of the transmitters;

a plurality of receivers, each receiver having a means to receive a user-set special coded signal from the transmitter, wherein each receiver is programmed to receive one of either the common coded signals from the transmitter or a unique coded signal from the transmitter, and each receiver having a function selector switch to select modes of operation for the receiver for producing a receiver output signal to activate a remote device upon receipt of a programmed special coded signal from the transmitter, so that the transmitter can selectively produce an output signal to activate the receivers with the common coded signals or sequentially activate one or more of the receivers with the unique coded signals; and a power source for the receiver.

3. An apparatus for the activation of a remote device, comprising:

a transmitter for generating and transmitting a user-set special coded signals, the special coded signals set by a code selector switch, and the transmitter having a function selector switch to select modes of operation for the transmitter; wherein said function selector switch selects the following modes of operation for said transmitter:

(a) a transmit/fire mode that enables a fire signal to be transmitted;

(b) a wake-up mode that enables a set-up mode for immediate firing;

(c) a program mode for transmission of programmed codes; and (d) a test and operation mode that enables an operational test of the apparatus with no firing output;

a power source for the said transmitter a receiver with means to receive said user-set special coded signals, said receiver having an output means, and said receiver having a function selector switch to select modes of operation for said receiver, wherein said function selector switch selects the one of the following modes of operation for said receiver:

(a) receive a wake-up and fire signal;

(b) actuate said output means;

(c) provide a continuity test for a blasting cap;

(d) program said receiver for receiving programmed codes; and (e) conduct operational tests of said receiver.; and a power source for said receiver.

4.The apparatus of claim 3, wherein said output means of said receiver comprises an electrical excitation output.

5. The apparatus of claim 3, wherein said output means of said receiver comprises an electromechanical solenoid output.

6. An apparatus for the activation of remote device, comprising:

a transmitter having a means for generating and transmitting via an antenna user-set special coded signals, the special coded signals selected from a first group of common coded signals and a second group of unique coded signals for the transmitter, the transmitter having a function selector switch to select modes of operation for the transmitter, wherein a signal representing the selected mode of operation is transmitted in association with a special coded signal, and the transmitter further having an input means for receiving an electrical signal and for transmitting a signal representative of a selected mode of operation;

a power source for each of the transmitters;

a receiver having a means to receive a user-set special coded signal from the transmitter, wherein the receiver is programmed to receive one of either the common coded signal from the transmitter or a unique coded signal from the transmitter, and the receiver having a function selector switch to select modes of operation for the receiver for producing a receiver output signal to activate a remote device upon receipt of a programmed special coded signal from the transmitter, and the receiver further having an output means for producing an electrical output signal and for conveying the electrical output signal to the input means of a transmitter for causing the transmitter to transmit a signal representative of a selected mode of operation of the transmitter; and a power source for the receiver.

* * * * *